United States Patent [19]

Padgett

[11] Patent Number: 4,834,342

[45] Date of Patent: May 30, 1989

[54] NAIL DRIVER

[76] Inventor: Edwin Padgett, P.O. Box 400, Lady Lake, Fla. 32659

[21] Appl. No.: 196,686

[22] Filed: May 20, 1988

[51] Int. Cl.[4] ..... B25C 5/02

[52] U.S. Cl. ..... 227/147; 227/66; 227/113; 227/131; 227/120

[58] Field of Search ..... 227/120, 113, 147, 149, 227/156, 66, 130, 131

[56] References Cited

U.S. PATENT DOCUMENTS

| | | | |
|---|---|---|---|
| 4,511,074 | 4/1985 | Kille et al. | 227/131 |
| 4,610,188 | 9/1986 | Hallock | 227/113 X |
| 4,610,381 | 9/1986 | Kramer et al. | 227/66 X |
| 4,730,860 | 3/1988 | Padgett | 294/49 |

OTHER PUBLICATIONS 11782, 10/87, Brookstone Company Catalog.

*Primary Examiner*—Paul A. Bell
*Attorney, Agent, or Firm*—Oltman and Flynn

[57] ABSTRACT

A nail driver comprising a generally T-shaped body having a barrel, a hollow plunger slidably reciprocable in the barrel, a rigid stem on the body extending centrally along the inside of the barrel into the hollow plunger, a spring biasing the plunger to an extended position forward past the front end of the barrel, a magnet tip loosely coupled pivotally to the stem at its front end and having saw teeth on the bottom, and an insert carried by the plunger and having saw teeth on the top. With the magnet tip holding a nail extending lengthwise inside the barrel and the front end of the plunger held against the object into which a nail is to be driven, when the body is pushed forward along the plunger toward that object, the saw teeth on the magnet tip ride bumpily across the saw teeth on the insert, causing the magnet tip and the nail it holds to vibrate up and down as it is driven into the object.

21 Claims, 3 Drawing Sheets

N
N'

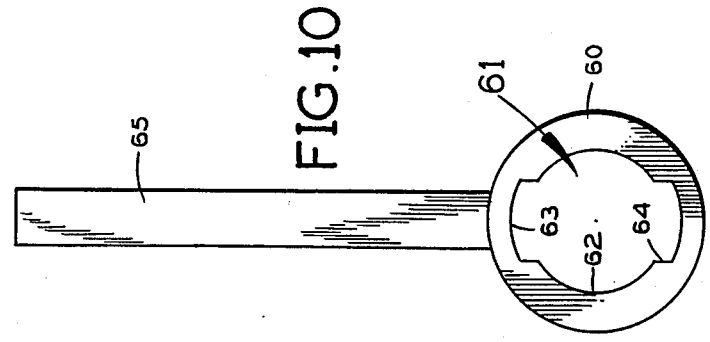
FIG.10
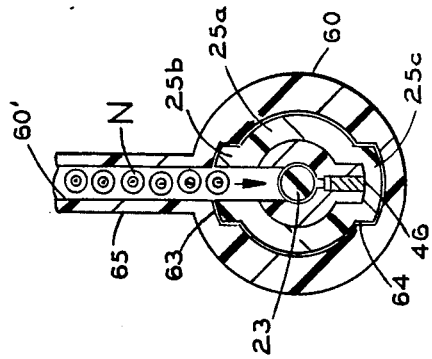
FIG.12
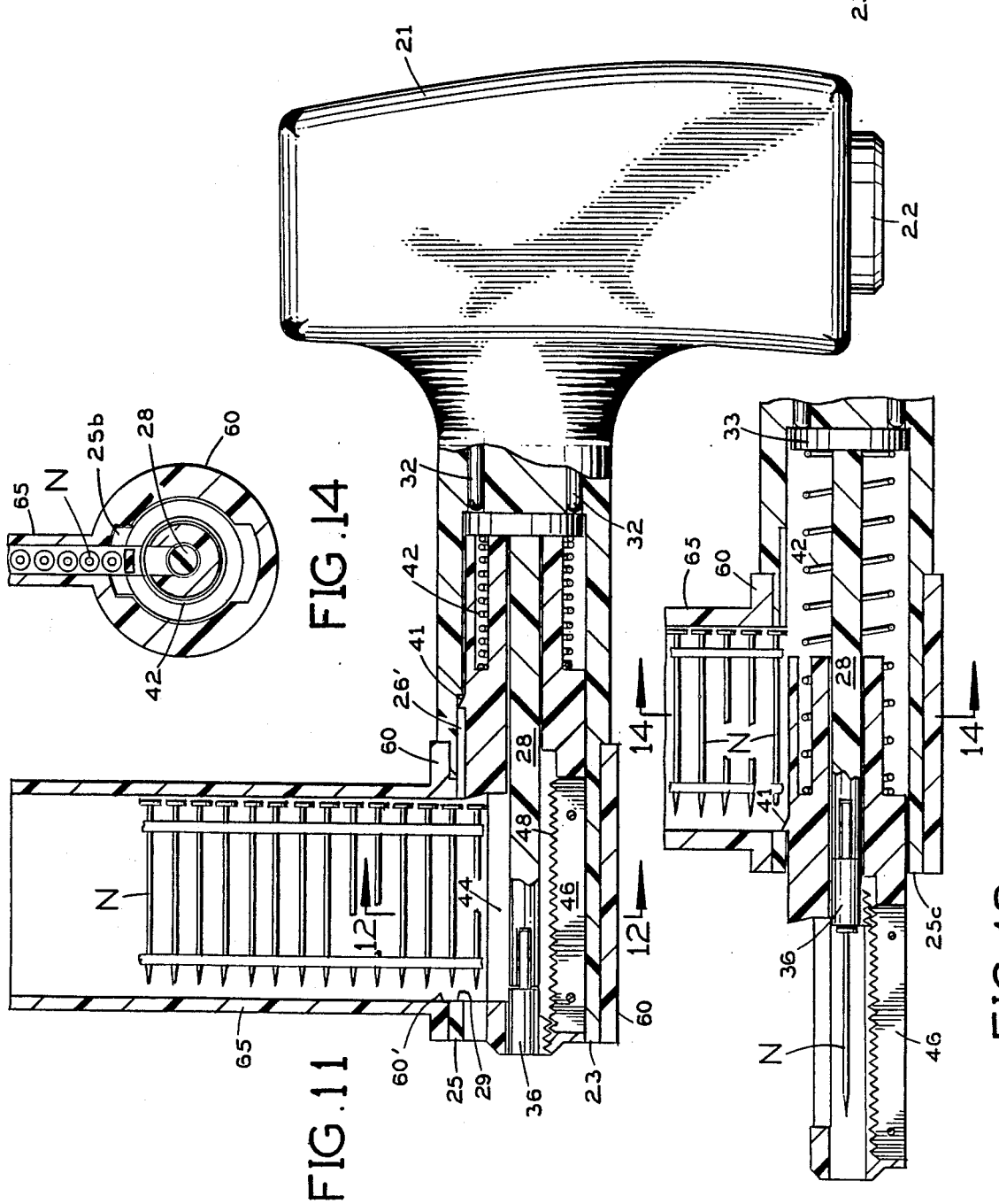
FIG.14
FIG.11
FIG.13

NAIL DRIVER

SUMMARY OF THE INVENTION

This invention relates to a nail driver.

A principal object of this invention is to provide a nail driver which vibrates the nail while driving it in.

In accordance with the present invention, the nail driver comprises a body having an elongated barrel, a magnet tip at the front end of the barrel coupled to the body to be able to vibrate, and a plunger reciprocable in the barrel and spring-biased to an extended position projecting forwardly beyond the front end of the barrel and the magnet tip. The magnet tip holds a nail extending axially in front of the barrel with its pointed end behind the front end of the plunger when the plunger is in its extended position. With the front end of the plunger against the object into which the nail is to be driven, when the body of the nail driver is pushed toward that object, the nail held by the magnet tip is forced into the object. Saw teeth on the magnet tip and the plunger bump over one another, causing the magnet tip and the nail to vibrate as the nail is driven in.

Further objects and advantages of this invention will be apparent from the following detailed description of three presently preferred embodiments which are illustrated schematically in the accompanying drawings.

DESCRIPTION OF THE DRAWINGS

FIG. 4 is a cross-section taken along the line 4—4 in FIG. 3;

FIG. 5 is a cross-section taken along the line 5—5 in FIG. 3;

FIG. 6 is a cross-section taken along the line 6—6 in FIG. 3;

FIG. 7 is a cross-section taken along line 7—7 in FIG. 3;

FIG. 8 is a view similar to FIG. 3 and showing the nail driver driving a nail into a wall or the like;

FIG. 9 is a fragmentary perspective view showing the parts of this nail driver which vibrate the nail as it is being driven in;

FIG. 10 is a partial front elevation of a second embodiment of this invention;

FIG. 11 shows this second embodiment partly in side elevation and with its operating parts in longitudinal section in their position at the completion of a nail-driving operation;

FIG. 12 is a fragmentary cross-section taken along the line 12—12 in FIG. 11;

FIG. 13 is a fragmentary longitudinal section showing this second embodiment of the invention after it has received a nail from the magazine but before it has driven that nail into the wall or other object into which it will be inserted;

FIG. 14 is a fragmentary cross-section taken along the line 14—14 in FIG. 13; and FIG. 15 is a fragmentary longitudinal section showing a third embodiment of the present invention in the position of its operating parts at the completion of a nail driving operation.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION FIGS. 1-9

Figures 1, 2, 3:
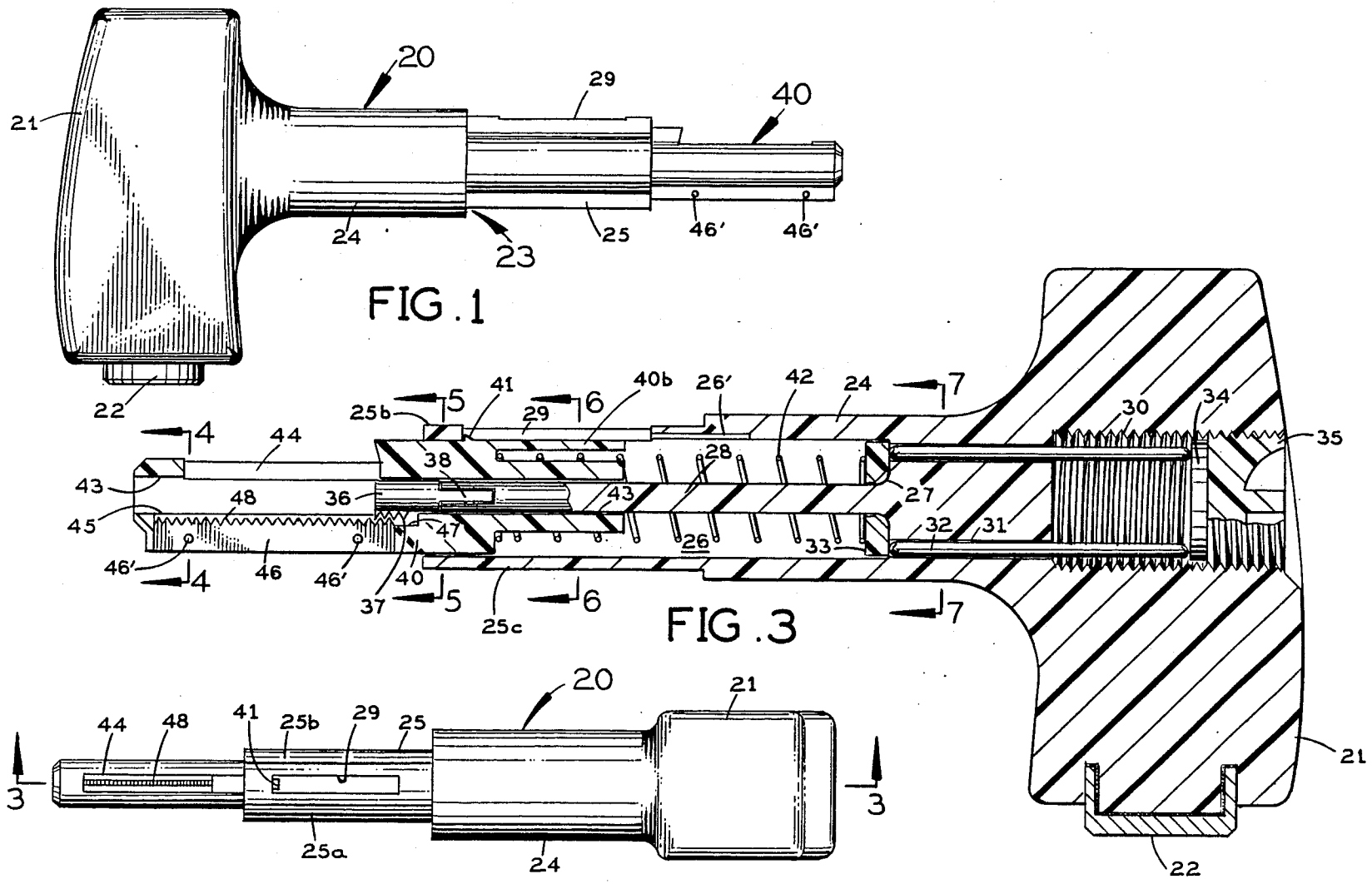
FIG. 1 is a side elevation of a first embodiment of the present invention.
FIG. 2 is a top plan view.
FIG. 3 is a longitudinal section taken along the line 3—3 in FIG. 2.
Figures 4, 5, 6, 7, 8, 9, 15:
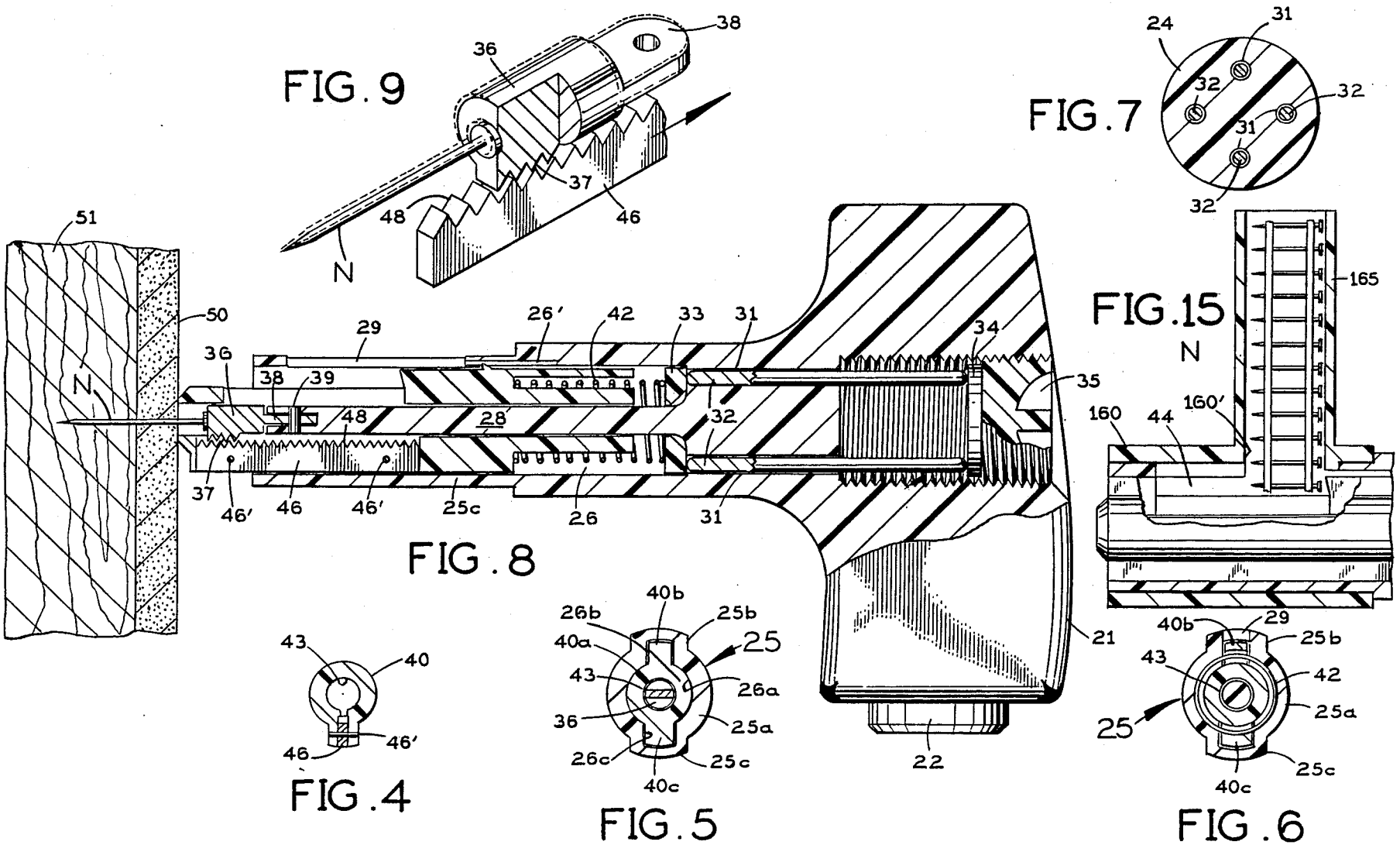

Referring to FIG. 1, in broad outline the first embodiment of the present nail driver comprises a body 20 of roughly T-shape and a plunger 40 slidably reciprocable in body 20 from left to right in FIG. 1 between an extended position, as shown there, and a retracted position, as shown in FIG. 8.

The body 20 of the nail driver has a cross head 21 at one end which may be used as a handle in the ordinary operation of this device as a nail driver. This cross head carries a hammer head 22 at its lower end for use when the device is used as a hammer.

Extending perpendicularly from the cross head 21 about midway between its upper and lower ends is an elongated annular barrel 23 in which the plunger 40 is reciprocable. The barrel may be used as a handle, gripped by a person's hand, when the device is used as a hammer. This barrel has a rear segment 24, which is cylindrical on the outside and is joined to the cross head 21, and a front segment 25 which, as shown in FIGS. 5 and 6, has a cylindrical middle section **25*a* and rounded lobes 25*b* and 25*c*** on the top and bottom.

Barrel 23 has a longitudinal recess indicated generally at 26 in FIGS. 3 and 8. For most of the length of this recess 26, its cross-sectional shape is as shown in FIG. 5, comprising a cylindrical bore **26*a* in the middle and straight slots 26*b* and 26*c* of generally rectangular cross-section extending along the top and bottom of this bore and opening into it. In its front segment 25 the barrel has an elongated straight opening 29 in the top (FIGS. 2 and 3) which opens down into the upper slot 26*b* of recess 26. Nails may be inserted one at a time down through opening 29 into the barrel recess 26. Behind this top opening 29 the barrel is formed with a shallow elongated groove 26' (FIG. 3) along the top of its recess 26. Groove 26' has the same width as the top opening 29** and it constitutes a rearward extension of the bottom part of this opening.

The opposite end of the longitudinal recess 26 in barrel 23 is closed by an internal surface 27 of body 20 which extends perpendicular to the axis of the barrel. Body 20 has an integral, elongated, rigid, internal stem 28 of solid cylindrical shape which extends perpendicularly from its internal surface 27 and centrally of the barrel recess 26.

The cross head 21 of body 20 is formed with a screw-threaded recess 30 (FIG. 3), which is open at the opposite side of the cross head from the barrel 23 and is coaxial with and spaced the longitudinal recess 26 in the barrel. Body 20 is formed with a plurality of circumferentially spaced, small diameter openings 31 (FIGS. 3 and 7) extending between the respective inner ends of the long recess 26 in barrel 23 and the screw-threaded recess 30 in cross head 21. A plurality of pins 32 are slidably received in the openings 31. At the front end these pins abut against a metal washer 33, which is slidable along the stem 28 of body 20 inside the longitudinal recess in barrel 23. At the back end the pins 32 abut against a metal washer 34 inside the screw-threaded recess 30 in body 20. An adjustment screw 35 is threadedly received in the outer end of recess 30. The inner end of this adjustment screw engages washer 34. Depending upon the position of the adjustment screw 35, the washer 33 may be positioned (as shown) abutting against the body surface 27 at the closed end of barrel recess 26 or it may be positioned forwardly along this recess away from surface 27.

A permanent magnet tip 36 is mounted on the front end of stem 28 in such a manner that it can vibrate up and down in FIG. 3. The magnet tip projects forward past the front edge of barrel 23 and here it presents a series of surface irregularities or discontinuities in the form of saw teeth 37 on the bottom in succession along its length, for a purpose explained hereinafter. As shown in FIG. 8, the magnet tip has a flat back end segment 38 which is loosely received in similarly shaped recess in the front end of stem 28. A vertically disposed cross pin 39 couples the back end segment 38 of magnet tip 36 to the stem 28 with sufficient play that the magnet tip can vibrate up and down.

As shown in FIG. 5, for part of its length the plunger 40 has a cross-section complementary to the longitudinal recess 26 in barrel 23, with a cylindrical middle segment 40*a* slidably received in bore 26*a*′ and top and bottom lobes 40*b* and 40*c* slidably received in slots 26*b* and 26*c* of recess 26.

At the top, plunger 40 has an upwardly projecting tooth 41 which is slidably received in the top opening 29 in the barrel and is slidably receivable in groove 26′ at the back end of this opening. Tooth 41 has a vertical front face for abutting engagement with the front end of opening 29 to provide a forward limit stop for plunger 40 along the barrel 23 of the nail driver body, as shown in FIG. 3.

A coil spring 42 is engaged under compression between plunger 40 and washer 33 to bias the plunger forward to its extended position, shown in FIG. 3, in which the plunger tooth 41 engages the front end of the top opening 29 in barrel 23. FIG. 1 also shows plunger 40 in this extended position, projecting forwardly past the front edge of barrel 23. The bias force exerted by spring 42 on the plunger is selectively adjustable by means of the adjusting screw 35.

Plunger 40 has an axial cylindrical bore 43 which slidably receives the stem 28 of body 20. Bore 43 extends the entire length of the plunger, as shown in FIGS. 3,4,5 and 6.

The front half of plunger 40 has a top opening 44 (FIGS. 2 and 3) which is elongated lengthwise of the plunger and is wide enough to pass a nail down into the plunger bore 43.

The front half of plunger 40 also has a narrow, elongated bottom opening 45 in which an insert 46 is held by cross pins 46′ (FIGS. 2 and 4). Along the top, the insert 46 presents a series of surface irregularities or discontinuities in the form of saw teeth 48 in succession lengthwise of plunger 40. At the back end of this bottom opening 45, the plunger presents a recess 47 which is an extension of the top part of this opening and extends down from the plunger bore 43. In the extended position of plunger 40 (FIG. 3), the saw teeth 37 on the bottom of magnet tip 36 are received partly in this recess 47 and partly in the bottom opening 45. The saw-toothed insert 46 carried by plunger 46 is positioned so that its saw teeth 48 engage the saw teeth 37 on the magnet tip in such a manner that the respective saw teeth can ride bumpily over each other and in doing so they cause the magnet tip 36 to vibrate up and down.

OPERATION

With the parts of the nail driver positioned as shown in FIG. 3 (the extended position of plunger 40), a person may drop a nail through the plunger's top opening 44 down into the plunger bore 43 in front of magnet tip 36. The magnet tip will draw the head of this nail against itself and the nail will extend substantially axially of the plunger bore 43.

The user now positions the front edge of plunger 40 against the surface of the wall or other object into which the nail is to be driven. Then the user pushes the body 20 of the nail driver toward this surface. The magnet tip 36 now moves in unison with body 20 to the left in FIG. 3 and its saw teeth 37 ratchet over the saw teeth 48 on the insert 46 carried by plunger 40. This causes the magnet tip to vibrate up and down, and the nail with it, as the nail is driven into the wall or other object. This vibration of the nail makes it easier to penetrate the object into which it is being driven such as, in FIG. 3, a wall having an outer layer 50 of plaster or wallboard over a wood stud 51 behind.

As shown in FIG. 8, the spring 42 becomes progressively more compressed as the body 20 moves toward the wall or other object against which the front end of plunger 40 is held. The nail N will be completely driven in before the back end of plunger 40 can strike washer 33 or the front end of barrel 23 can strike the object into which the nail is being driven.

A nail can be inserted into the nail driver and driven into the wall or other object without moving the front end of the plunger 40 from engagement with it. With the plunger held against the object and the body 20 of the nail driver retracted along the plunger, as shown in FIG. 3, a nail may be dropped into the top opening 29 of barrel 23. In this position of the parts, the plunger 40 blocks the nail. As the user forces the body 20 forward along the plunger 40 (i.e., toward the wall or other object), when the barrel opening 29 registers with the top opening 44 in the plunger, the nail drops down into the plunger bore opening 44 but not further into bore 43 because the magnet tip 36 and body 28 block it. When the body 20 now is retracted along plunger 40, this nail can drop into the plunger recess 43 where it will be held axially by magnet tip 36, as described. Then, when the body 20 is moved forward again (still holding plunger 40 against the wall or other object) this nail is driven in as already described. FIGS. 10–14

FIGS. 10–14 show a second embodiment which is identical to the embodiment of FIGS. 1–9 except for the addition of a magazine from which nails are fed automatically into the barrel one at a time by gravity. Elements of the device in FIGS. 10–14 which correspond to those in FIGS. 1–9 are given the same reference numerals, and the detailed description of these elements need not be repeated.

The magazine has a tubular segment 60 at its lower end which fits snugly but slidably over the front segment 25 of the barrel 23. As shown in FIGS. 10 and 12, the tubular lower end segment 60 of the magazine has a longitudinal opening 61 along its entire length which has a cylindrical bore 62 at the middle for slidably receiving the cylindrical middle part 25*a* of front segment 25 of barrel 23, a slot 63 along the top of bore 62 for slidably receiving the top lobe 25*b* of the front segment 25 of the barrel, and a slot 64 along the bottom of bore 62 for slidably receiving the bottom lobe 25*c* of front segment 25 of the barrel.

The magazne has a hollow, vertical column 65 (FIG. 11) of oblong rectangular cross-section extending up from its lower end segment 60 for holding a stack of nails N, as shown in FIGS. 11 and 12. The lower end segment 60 of the magazine has an opening 60' at the top which registers with the interior of column 65 and with the top opening 29 in front segment of barrel 23.

OPERATION

When the plunger 40 is pressed against the wall or other object into which a nail is to be driven, it assumes the position shown in FIG. 11 in which it is retracted into the longitudinal recess 26 in barrel 23 of the nail driver. In this position of the parts, the top opening 44 in the plunger registers with the top opening 29 in barrel 23 and with the interior of the magazine column 65. Therefore, the lowermost nail in the magazine can drop down into the plunger opening 44 but not into the bore 43 because stem 28 blocks it. When the user now retracts the body 20 of the nail driver while continuing to hold plunger 40 against the wall or other object, the lowermost nail now drops from the opening 44 in plunger 40 down into the plunger bore 43 in front of magnet tip 36, which holds it by magnetic attraction and positions it as shown in FIG. 13. Then, when the user moves the body 20 of the nail driver toward the wall or other object, it drives the nail into that object in the manner already described, with the teeth 37 on magnet tip 36 bumping across the teeth 48 on the plunger insert 46 to cause the nail to vibrate up and down as it is driven into the object.

FIG. 15

FIG. 15 shows a third embodiment of the invention which is similar to the second embodiment in that it has a magazine for holding nails but differs from it in that the nails are substantially shorter than those in the first and second embodiments of the invention. Elements of the magazine in FIG. 15 which correspond to those in the second embodiment (FIGS. 10–14) have the same reference numerals plus 100.

In FIG. 15, the vertical column 165 of the nail magazine has a substantially shorter front-to-back dimension than the magazine column 65 in FIG. 11 because it holds shorter nails. The tubular lower end segment 160 of the magazine in FIG. 15 has a correspondingly longer front-to-back dimension in front of the vertical columm 165 than does the lower end segment 60 of the magazine in FIG. 11. In other respects the apparatus of FIG. 15 is the same as that of FIG. 11.

I claim:

1. In a nail driver comprising:

a body having a barrel with an open front end;

a hollow plunger having an open front end and slidably reciprocable in said barrel;

and spring means biasing said plunger to an extended position in which its front end is forward past the front end of the barrel;

the improvement which comprises:

holding means on said body for holding a nail extending along the inside of said plunger to pass forward through the open front end of the plunger when the barrel is moved forward along the plunger;

and means acting between said plunger and said holding means for vibrating said holding means transversely of said barrel and said plunger in response to movement of the barrel forward along the plunger.

2. A nail driver according to claim 1 wherein said holding means is a magnet tip which holds a nail magnetically and is mounted on the body for vibrating movement with respect to said barrel.

3. A nail driver according to claim 2 wherein said plunger has an elongated top opening therein which extends in front of said magnet tip in said extended position of the plunger for the entry of a nail into the hollow plunger in front of said magnet tip.

4. A nail driver according to claim 3 and further comprising:

a magazine presenting a nail supply chamber extending up from said barrel;

said barrel having a top opening therein below said nail supply chamber of the magazine and positioned to register with said top opening in the plunger when the barrel is forward along the plunger from said extended position of the plunger with respect to the barrel.

5. A nail driver according to claim 3 wherein:

said barrel has a top opening therein positioned to register with said top opening in the plunger when the barrel is forward along the plunger from said extended position of the plunger with respect to the barrel;

and said plunger at the top thereof has an upwardly projecting lip slidably received in said top opening in the barrel and engageable with the front end of said top opening in the barrel in said extended position of the plunger.

6. A nail driver according to claim 2 and further comprising:

means for selectively adjusting the biasing force of said spring means on said plunger.

7. In a nail driver comprising:

a body having a barrel with an open front end;

a hollow plunger having an open front end and slidably reciprocable in said barrel;

and spring means biasing said plunger to an extended position in which its front end is forward past the front end of the barrel;

the improvement which comprises:

holding means on said body for holding a nail extending along the inside of said plunger to pass forward through the open front end of the plunger when the barrel is moved forward along the plunger, said holding means being a magnet tip which holds a nail magnetically and is mounted on the body for vibrating movement with respect to said barrel;

and means for vibrating said holding means when the barrel is moved forward along the plunger, said means for vibrating comprising:

a series of surface irregularities on the magnet tip in succession longitudinally of the barrel;

and means on said plunger presenting surface irregularities in succession longitudinally of the plunger and in confronting relationship to said surface irregularities on the magnet tip.

8. A nail driver according to claim 7 and further comprising:

means pivotally coupling said magnet tip to said body loosely inside said barrel adjacent its front end and permitting vibration of the magnet tip with respect to said barrel.

9. A nail driver according to claim 8 wherein:

said surface irregularities on the magnet tip are saw teeth;

and said means on said plunger presenting surface irregularities is an insert carried by the plunger and having saw teeth thereon.

10. A nail driver according to claim 9 wherein said plunger has a top opening therein which is elongated lengthwise of the plunger and extends in front of said magnet tip when the plunger is in said extended position, said top opening being dimensioned to pass a nail down into the hollow plunger in front of said magnet tip to be held magnetically by said magnet tip.

11. A nail driver according to claim 10 and further comprising:

means for selectively adjusting the biasing force of said spring means on said plunger.

12. In a nail driver comprising:

a body having a barrel with a front end;

a plunger slidably reciprocable in said barrel and having a front end;

and spring means biasing said plunger to an extended position in which its front end is located forward beyond the front end of the barrel;

the improvement which comprises:

a magnet tip projecting forward beyond the front end of the barrel but behind the front end of the plunger when the plunger is in said extended position;

coupling means coupling said magnet tip to said body inside said barrel for movement of said magnet tip in unison with said barrel along said plunger, said coupling means permitting the magnet tip to vibrate with respect to said barrel;

means for vibrating said magnet tip when said barrel is moved forward along said plunger;

said means for vibrating comprising:

a series of saw teeth on said magnet tip in succession along its length;

and means on said plunger providing a series of saw teeth in succession along its length which are in confronting relationship to said saw teeth on the magnet tip and which ride over said saw teeth on the magnet tip for causing the magnet tip to vibrate when the barrel moves along the plunger.

13. In a nail driver comprising:

a body having a barrel with a front end;

a plunger slidably reciprocable in said barrel and having a front end;

and spring means biasing said plunger to an extended position in which its front end is located forward beyond the front end of the barrel;

the improvement which comprises:

a magnet tip projecting forward beyond the front end of the barrel but behind the front end of the plunger when the plunger is in said extended position;

coupling means coupling said magnet tip to said body inside said barrel for movement of said magnet tip in unison with said barrel along said plunger, said coupling means permitting the magnet tip to vibrate transversely with respect to said barrel;

and means for vibrating said magnet tip transversely of said barrel and said plunger when said barrel is moved forward along said plunger.

14. A nail driver according to claim 13 wherein:

said body has a rigid stem extending along the inside of said barrel toward said front end of the barrel;

said magnet tip extends in front of said stem;

and said coupling means pivotally couples said magnet tip to said stem.

15. A nail driver according to claim 14 wherein:

said plunger has a longitudinal bore therein which slidably receives said stem and part of which extends in front of said magnet tip in said extended position of the plunger, said bore being open at the front end of the plunger;

and said plunger has a top openign therein leading down into said bore for passing a nail down into the bore in front of said magnet tip in said extended position of the plunger.

16. A nail driver according to claim 13 and further comprising:

means for selectively adjusting the bias force of said spring means on said plunger.

17. In a nail driver comprising:

a body having a barrel with a front end, said body having a rigid stem extending along the inside of said barrel toward said front end of the barrel;

a plunger slidably reciprocable in said barrel and having a front end;

and spring means biasing said plunger to an extended position in which its front end is located forward beyond the front end of the barrel;

a magnet tip projecting forward beyond the front end of the barrel but behind the front end of the plunger when the plunger is in said extended position, said magnet tip extending in front of said stem;

a plunger slidably reciprocable in said barrel and having a front end;

and spring means biasing said plunger to an extended position in which its front end is located forward beyond the front end of the barrel;

the improvement which comprises:

a magnet tip projecting forward beyond the front end of the barrel but behind the front end of the plunger when the plunger is in said extended position, said magnet tip extending in front of said stem;

said plunger having a longitudinal bore therein which slidably receives said stem and part of which extends in front of said magnet tip in said extended position of the plunger, said bore being open at the front end of the plunger;

and said plunger having a top opening therein leading down into said bore for passing a nail down into the bore in front of said magnet tip in said extended position of the plunger;

coupling means pivotally coupling said magnet tip to said stem inside said barrel for movement of said magnet tip in unison with said barrel along said plunger, said coupling means permitting the magnet tip to vibrate with respect to said barrel;

means for vibrating said magnet tip when said barrel is moved forward along said plunger;

said means for vibrating comprising:

a series of saw teeth on said magnet tip in succession along its length on the bottom;

and an insert received in said plunger below said part of the bore which extends in front of said magnet tip in said extended position of the plunger, said insert having a series of saw teeth on the top in succession lengthwise of said bore which are positioned to ride bumpily over said saw teeth on the magnet tip and thereby cause the magnet tip to vibrate up and down when the barrel moves forward with respect to the plunger.

18. In a nail driver comprising:

a body having a barrel with a front end, said body having a rigid stem extending along the inside of said barrel toward said front end of the barrel;

a plunger slidably reciprocable in said barrel and having a front end;

and spring means biasing said plunger to an extended position in which its front end is located forward beyond the front end of the barrel;

the improvement which comprises:

a magnet tip projecting forward beyond the front end of the barrel but behind the front end of the plunger when the plunger is in said extended position, said magnet tip extending in front of said stem;

said plunger having a longitudinal bore therein which slidably receives said stem and part of which extends in front of said magnet tip in said extended position of the plunger, said bore being open at the front end of the plunger;

and said plunger having a top opening therein leading down into said bore for passing a nail down into the bore in front of said magnet tip in said extended position of the plunger;

coupling means pivotally coupling said magnet tip to said stem inside said barrel for movement of said magnet tip in unison with said barrel along said plunger, said coupling means means permitting the magnet tip to vibrate with respect to said barrel;

means for vibrating said magnet tip when said barrel is moved forward along said plunger;

said means for vibrating comprising:

a series of saw teeth on said magnet tip in succession along its length on the bottom;

and an insert received in said plunger below said part of the bore which extends in front of said magnet tip in said extended position of the plunger, said insert having a series of saw teeth on the top in succession lengthwise of said bore which are positioned to ride bumpily over said saw teeth on the magnet tip and thereby cause the magnet tip to vibrate up and down when the barrel moves forward with respect to the plunger.

19. A nail driver according to claim 18 and further comprising:

a magazine presenting a nail supply chamber extending up from said barrel;

said barrel having a top opening therein below said nail supply chamber of the magazine and positioned to register with said top opening in the plunger when the barrel is forward along the plunger from said extended position of the plunger with respect to the barrel.

20. A nail driver according to claim 19 wherein said plunger has an upwardly projecting lip slidably received in said top opening in the barrel and engageable with the front end of said top opening in the barrel in said extended position of the plunger.

21. In a nail driver comprising:

a body having a barrel with an open front end;

a hollow plunger having an open front end and slidably reciprocable in said barrel;

and spring means biasing said plunger to an extended position in which its front end is forward past the front end of the barrel;

the improvement which comprises:

holding means on said body for holding a nail extending along the inside of said plunger to pass forward through the open front end of the plunger when the barrel is moved forward along the plunger, said holding means being a magnet tip which holds a nail magnetically and is mounted on the body for vibrating movement with respect to said barrel;

means pivotally coupling said magnet tip to said body loosely inside said barrel adjacent its front end and permitting vibration of the magnet tip with respect to said barrel;

and means for vibratign said holding means when the barrel is moved forward along the plunger, said means for vibrating comprising:

a series of saw teeth on the magnet tip in succession longitudinally of the barrel;

and an insert carried by plunger and having saw teeth in succession longitudinally of the plunger and in confronting relationship to said saw teeth on the magnet tip;

said plunger having a top opening therein which is elongated lengthwise of the plunger and extends in front of said magnet tip when the plunger is in said extended position, said top opening being dimensioned to pass a nail down into the hollow plunger in front of said magnet tip to be held magnetically by said magnet tip;

and a magazine presenting a nail supply chamber extending up from said barrel;

said barrel having a top opening therein below said nail supply chamber of the magazine and positioned to register with said top opening in the plunger when the barrel is forward along the plunger from said extended position of the plunger with respect to the barrel.

* * * * *